US011519046B2

(12) United States Patent
Zhou et al.

(10) Patent No.: US 11,519,046 B2
(45) **Date of Patent: *Dec. 6, 2022**

(54) COLD-ROLLED HIGH-STRENGTH STEEL PLATE HAVING EXCELLENT PHOSPHATING PERFORMANCE AND FORMABILITY AND MANUFACTURING METHOD THEREFOR

(71) Applicant: BAOSHAN IRON & STEEL CO., LTD., Shanghai (CN)

(72) Inventors: Shu Zhou, Shanghai (CN); Yong Zhong, Shanghai (CN); Xinyan Jin, Shanghai (CN); Li Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 310 days.

This patent is subject to a terminal disclaimer.

(21) Appl. No.: 16/328,980

(22) PCT Filed: Aug. 29, 2017

(86) PCT No.: PCT/CN2017/099420

§ 371 (c)(1),
(2) Date: Feb. 27, 2019

(87) PCT Pub. No.: WO2018/041088

PCT Pub. Date: Mar. 8, 2018

(65) Prior Publication Data

US 2019/0194770 A1 Jun. 27, 2019

(30) Foreign Application Priority Data

Aug. 30, 2016 (CN) ..... 201610771212.9

(51) Int. Cl.
*C21D 8/02* (2006.01)
*C22C 38/02* (2006.01)
(Continued)

(52) U.S. Cl.
CPC ..... *C21D 8/0263* (2013.01); *C21D 8/02* (2013.01); *C22C 38/001* (2013.01); *C22C 38/02* (2013.01);
(Continued)

(58) Field of Classification Search
CPC ..... C21D 8/0263; C21D 8/02; C21D 8/0205; C21D 8/0226; C21D 8/0236;
(Continued)

(56) References Cited

U.S. PATENT DOCUMENTS

2014/0287263 A1* 9/2014 Kawata ..... B32B 15/013 428/659
2015/0337416 A1* 11/2015 Zhong ..... C22C 38/04 148/546
(Continued)

FOREIGN PATENT DOCUMENTS

CN 103805838 5/2014
CN 105483526 4/2016
(Continued)

OTHER PUBLICATIONS

International Search Report and Written Opinion for PCT Application No. PCT/CN2017/099420.
(Continued)

*Primary Examiner* — John A Hevey
(74) *Attorney, Agent, or Firm* — Lei Fang, Esq.; Smith Tempel Blaha LLC

(57) ABSTRACT

A cold-rolled high-strength steel plate having excellent phosphating performance and formability and a manufacturing method therefor. The chemical composition of the
(Continued)

steel plate is, in percentage by weight, C 0.01-0.20%, Si 1.50-2.50%, Mn 1.50-2.50%, P≤0.02%, S≤0.02%, Al 0.03-0.06%, N≤0.01%, the remainder being Fe and impurities. The surface layer of the steel plate has an inner oxide layer with a thickness of 1-5 μm, and there is no enrichment of Si and Mn on the surface of the steel plate. The steel plate has tensile strength of ≥980 MPa and an elongation of ≥20%. The structure at the room temperature contains retained austenite, ferrite, and martensite and/or bainite.

12 Claims, 3 Drawing Sheets

(51) Int. Cl.
*C22C 38/04* (2006.01)
*C22C 38/06* (2006.01)
*C22C 38/00* (2006.01)

(52) U.S. Cl.
CPC ..... *C22C 38/04* (2013.01); *C22C 38/06* (2013.01); *C21D 8/0205* (2013.01); *C21D 8/0226* (2013.01); *C21D 8/0236* (2013.01); *C21D 2211/002* (2013.01); *C21D 2211/008* (2013.01)

(58) Field of Classification Search
CPC ..... C21D 2211/002; C21D 2211/008; C21D 1/74; C21D 8/0247; C21D 2211/001; C21D 2211/005; C22C 38/001; C22C 38/02; C22C 38/04; C22C 38/06
See application file for complete search history.

(56) References Cited

U.S. PATENT DOCUMENTS

| | | | | |
|---|---|---|---|---|
| 2018/0312954 | A1* | 11/2018 | Yasui | C22C 38/32 |
| 2019/0194774 | A1* | 6/2019 | Zhou | C21D 6/005 |

FOREIGN PATENT DOCUMENTS

| | | | | |
|---|---|---|---|---|
| CN | 106244923 | | 12/2016 | |
| CN | 106350731 | | 1/2017 | |
| EP | 2840161 | | 2/2015 | |
| JP | 2003113441 | | 4/2003 | |
| JP | 2004323969 | | 11/2004 | |
| JP | 2005350720 | | 12/2005 | |
| KR | 20150086312 | | 7/2015 | |
| KR | 20150086312 | A * | 7/2015 | C22C 38/04 |

OTHER PUBLICATIONS

Korean Office Action dated Jun. 1, 2020 for Korean Patent Application No. 20197005611, and the English translation of the Office Action.
European Search Report dated Feb. 24, 2020 for European Patent Application No. 17845390.

* cited by examiner

COLD-ROLLED HIGH-STRENGTH STEEL PLATE HAVING EXCELLENT PHOSPHATING PERFORMANCE AND FORMABILITY AND MANUFACTURING METHOD THEREFOR

CROSS-REFERENCE TO RELATED APPLICATIONS

This application is a 371 U.S. National Phase of PCT International Application No. PCT/CN2017/099420 filed on Aug. 29, 2017, which claims benefit and priority to Chinese patent application no. 201610771212.9 filed on Aug. 30, 2016. Both of the above-referenced applications are incorporated by reference herein in their entireties.

TECHNICAL FIELD

The disclosure pertains to the field of cold-rolled high-strength steel, and particularly relates to a cold-rolled high-strength steel plate having excellent phosphatability and formability, and a manufacturing method thereof.

BACKGROUND ART

In recent years, more and more automobile plants have begun to pay attention to lightweight design of automobiles in order to meet the requirements of saving energy, reducing emission, improving collision safety, reducing manufacturing cost, etc. As one of the effective solutions to reduce automobile body weight, a large quantity of ultra-high-strength steel plates has been utilized in automobiles.

However, as the strength of a material increases, the formability of the material drops sharply, which leads to an increasingly prominent problem of cracking of parts during stamping, and also restricts application of high-strength steel plates to complicated parts of an automobile body. Therefore, it is necessary to develop a steel plate having both high strength and high formability. Generally, an automobile steel plate is phosphatized before coating to form a uniform and dense phosphated film on a surface of the steel plate, thereby improving adhesion of a coating, enhancing electrophoresis effect, and improving corrosion resistance of the coating. Therefore, phosphatability of a high-strength steel plate is also an important indicator that shows if the high-strength steel plate can be widely used in automobiles.

In order to improve formability of a high-strength steel plate, addition of Si element is recognized as the most effective method. However, during an annealing process, elements such as Si, Mn and the like are enriched in a surface of the steel plate to form oxides which hinder uniform reaction in a phosphating process, causing problems such a poor phosphating coverage, large phosphated crystal size, etc. These problems deteriorate phosphatability of the steel plate. In turn, coatability and corrosion resistance of the steel plate are affected. Therefore, under normal circumstances, the poor phosphatability of high Si cold-rolled high-strength steel plates has become a major problem of such products. In summary, it is necessary to develop a cold-rolled high-strength steel plate having a high Si content and excellent phosphatability and formability.

Chinese Patent Publication No. CN101583740B discloses a method of producing a high-strength cold-rolled steel plate. This steel plate comprises Si: 1.0 to 2.0% by mass and/or Mn: 2.0 to 3.0% by mass. In continuous annealing, a surface of the steel plate is exposed to an atmosphere in which iron is oxidized, such that the surface thereof is oxidized. After pickling at an outlet side of an annealing furnace, plating of iron or Ni at 1 to 50 mg/m$^2$ is performed to improve surface phosphatability of the steel plate. However, the patent does not mention how to control the degree of oxidation in the annealing process. Therefore, problems such as oxidation to nonuniform degrees, an excessive thickness of an oxide layer, incomplete pickling, etc, tend to occur. In addition, pickling and plating apparatus are required additionally in an annealing production line to complete the production process described in the patent, which means additional production cost.

Chinese Patent Application No. CN103124799AA discloses a high-strength steel plate and a method of manufacturing the same, the main points of which are as follows: the steel plate comprises, based on mass %, C: 0.01% to 0.18%, Si: 0.4% to 2.0%, Mn: 1.0% to 3.0%, Al: 0.01% to 1.0%, P: 0.005% to 0.060%, S<0.010%, and a balance of Fe and unavoidable impurities. When the steel plate is continuously annealed, the dew point of the atmosphere is controlled to become not more than −45° C. during the course of soaking when the temperature inside the annealing furnace is in the range of not less than 820° C. and not more than 1000° C., and the dew point of the atmosphere is controlled to become not more than −45° C. during the course of cooling when the temperature inside the annealing furnace is in the range of not less than 750° C. After the treatment by the method, surface enrichment of oxidizable elements such as Si, Mn and the like in the surface of the steel plate is suppressed, and internal and external oxidation of elements such as Si, Mn and the like is also suppressed. However, in real continuous annealing production, it is technically difficult to continuously, steadily control the dew point of the atmosphere not more than −45° C. Such control not only imposes very high requirements on production equipment and technology, but also has no advantage in production cost.

Chinese Patent Application No. CN103290309A discloses a high-strength steel plate and a method of manufacturing the same, wherein the steel plate comprises, by mass %, C of greater than 0.04%, Si of greater than 0.4%, Si content/Mn content >0.1. After annealing, the steel plate is pickled. Coverage of Si-based oxides on a surface of the steel plate is controlled to improve phosphatability of the steel plate. However, as mentioned in the patent application, in order to complete the pickling, the steel plate needs to be immersed in hydrochloric acid or sulfuric acid having a temperature of 50° C. or higher and a concentration of 10 mass % or higher for 6 s or longer to complete the pickling process. This process will deteriorate the delayed cracking property of the high-strength steel plate. Moreover, the pickling process is also disadvantageous in terms of environmental protection and production cost.

Chinese Patent Application No. CN102666923A discloses a high-strength cold-rolled steel plate and a method of manufacturing the same, wherein the steel plate comprises C: 0.05-0.3%, Si: 0.6-3.0%, Mn: 1.0-3.0%, P≤0.1%, S≤0.05%. Al: 0.01-1%, N≤0.01%, and a balance of Fe and unavoidable impurities. When the steel plate is continuously annealed, oxidation treatment before annealing is performed by controlling an oxygen concentration. The steel plate is heated for the first time in an atmosphere having an oxygen concentration of 1000 ppm or higher, until the temperature of the steel plate reaches 630° C. or higher. Then, the steel plate is heated for the second time in an atmosphere having an oxygen concentration of less than 1000 ppm, until the temperature of the steel plate reaches 700 to 800° C., so that an oxide amount of 0.1 g/m$^2$ or more is formed on the surface of the steel plate. Then, annealing is performed using a reducing atmosphere having a dew point of −25° C. or lower and 1-10% $H_2$—$N_2$. In this manufacturing method, an oxidation treatment process step is added before annealing, and a corresponding device is required for the production line. At the same time, the operation of controlling the heating temperature and the oxygen concentration is difficult. Most of the existing continuous annealing production lines do not have such a function. In addition, this method utilizes an atmosphere of a high oxygen content to achieve non-selective oxidation of the surface of the steel plate. However, the degree of oxidation reaction is very sensitive to the atmosphere. Hence, it's difficult to guarantee the uniformity of the reaction, and the thickness of the oxide layer and the degree of oxidation tend to be non-uniform. When a reduced iron layer is formed by subsequent reduction reaction, the thickness of the reduced iron layer also tends to be non-uniform, resulting in non-uniform phosphatability of the surface of the product.

SUMMARY

An object of the present disclosure is to provide a cold-rolled high-strength steel plate having excellent phosphatability and formability, and a method of manufacturing the same, wherein the cold-rolled high-strength steel plate has good phosphatability and formability, and has a tensile strength of 980 MPa or more, an elongation of 20% or more, and a room temperature structure comprising residual austenite, ferrite, martensite and/or bainite, suitable for manufacture of automobile structural parts and safety parts having complex shapes and high requirements for formability and corrosion resistance.

To achieve the above object, the technical solution of the disclosure is as follows:

A cold-rolled high-strength steel plate having excellent phosphatability and formability, comprising chemical elements in percentage by mass of: C 0.10 to 0.20%, Si 1.50 to 2.50%, Mn 1.50 to 2.50%, P≤0.02%, S≤0.02%, Al 0.03 to 0.06%, N≤0.01%, and a balance of Fe and unavoidable impurity elements, wherein a surface layer of the steel plate comprises an inner oxide layer having a thickness of 1 to 5 μm; the inner oxide layer comprises iron as a matrix; the matrix comprises oxide particles which are at least one of oxides of Si, composite oxides of Si and Mn; no Si or Mn element is enriched in the surface of the steel plate;

the oxide particles have an average diameter of 50 to 200 nm and an average spacing λ between the oxide particles satisfying the following relationship:

$$A=0.115\times(0.94\times[Si]+0.68\times[Mn])^{1/2}\times d$$

$$B=1.382\times(0.94\times[Si]+0.68\times[Mn])^{1/2}\times d$$

$$A\leq\lambda\leq B$$

wherein [Si] is the content % of Si in the steel; [Mn] is the content % of Mn in the steel; and d is the diameter of the oxide particles in nm.

Preferably, the oxide particles are at least one of silicon oxide, manganese silicate, iron silicate, and ferromanganese silicate.

The cold-rolled high-strength steel plate having excellent phosphatability and formability according to the disclosure has a tensile strength of 980 MPa or more, an elongation of 20% or more, and a room temperature structure having a residual austenite content of 5-15%, a ferrite content of no more than 50% and a balance of martensite and/or bainite.

In the compositional design according to the disclosure:

C: Carbon is a solid solution strengthening element necessary for ensuring strength in steel. It is an austenite stabilizing element. If the C content is too low, the content of residual austenite will be insufficient, and the material strength will be low; and if the C content is too high, the weldability of the steel material will be significantly deteriorated. Therefore, the carbon content is controlled at 0.10-0.20% according to the disclosure.

Si: Silicon has an effect of improving formability of the steel material while enhancing strength thereof. In order to ensure that the steel material should have a strength of 980 MPa or more and a formability characterized by an elongation of 20% or more, it is necessary to add a large amount of silicon in the present disclosure. However, excessive addition of Si will make the steel plate remarkably brittle, and cracking tends to occur at the end portions of the steel plate during cold rolling, thereby decreasing production efficiency. Therefore, the Si content is controlled at 1.50-2.50% according to the disclosure.

Mn: Manganese increases the stability of austenite. At the same time, it reduces the critical cooling temperature and the martensitic transformation temperature Ms during steel quenching, and improves hardenability of the steel plate. In addition, Mn is a solid solution strengthening element, which is advantageous for improving the strength of the steel plate. However, an excessively high Mn content causes cracking of a steel slab in a continuous casting process, and affects weldability of the steel material. Therefore, the Mn content is controlled at 1.50-2.50% according to the disclosure.

P: Phosphorus is an impurity element in the disclosure. It deteriorates weldability, increases cold brittleness of the steel, and lowers plasticity of the steel. Therefore, it is necessary to control P to be 0.02% or less.

S: Sulfur is also an impurity element. It deteriorates weldability, and lowers plasticity of the steel. Therefore, it is necessary to control S to be 0.01% or less.

Al: Aluminum is added for deoxygenation of molten steel. If the Al content is too low, the purpose of deoxygenation cannot be achieved; if the Al content is too high, the deoxygenating effect will be saturated. Therefore, the Al content is controlled at 0.03-0.06% according to the disclosure.

N: Nitrogen is an impurity contained in crude steel. N combines with Al to form AlN particles, which affects ductility and thermoplasticity of a steel plate. Therefore, it is desirable to control as far as possible the N content to be 0.01% or less in a steelmaking process.

The cold-rolled high-strength steel plate of the present disclosure is a high Si cold-rolled steel plate. In order to guarantee good phosphatability, an inner oxide layer exists in the surface layer of the steel plate. The inner oxide layer comprises iron as a matrix, and has a thickness of 1-5 μm. The inner oxide layer comprises oxide particles which are one or more of oxides of Si and composite oxides of Si and Mn.

Si and Mn elements are generally easily enriched to form oxides on a surface of a steel plate. Nevertheless, the inner oxide layer in the surface of the high Si cold-rolled high-strength steel plate of the present disclosure prevents elements such as Si and Mn from being enriched in the surface of the steel plate, such that oxidation of the above elements does not occur on the surface of the steel plate. That is, internal oxidation takes the place of external oxidation, thereby improving phosphatability of the steel plate.

In the cold-rolled high-strength steel plate of the present disclosure, the thickness of the inner oxide layer, the size of the oxide particles and the density of the oxide particles directly influence the function of the inner oxide layer to improve the surface state of the steel plate. The oxide particle density may be represented by an average spacing λ between the oxide particles, which is related to the Si, Mn contents and oxide particle diameter as follows:

$$A=0.115\times(0.94\times[Si]+0.68\times[Mn])^{1/2}\times d$$

$$B=1.382\times(0.94\times[Si]+0.68\times[Mn])^{1/2}\times d$$

$$A\leq\lambda\leq B$$

wherein [Si] is the content % of Si in the steel; [Mn] is the content % of Mn in the steel; and d is the diameter of the oxide particles in nm.

When the thickness of the inner oxide layer is less than 1 μm, the average diameter of the oxide particles is less than 50 nm and the average spacing is λ>B, the inner oxide layer cannot prevent elements such as Si and Mn from being enriched toward the surface of the steel plate, and a large amount of oxide particles will still be formed in the surface of the steel plate. In this case, external oxidation cannot be effectively suppressed, and these oxide particles will seriously hinder uniform reaction of a phosphating process, causing problems such as surface yellow rusting, poor phosphating, large phosphated crystal size and the like.

When the thickness of the inner oxide layer is >5 μm, the average diameter of the oxide particles is >200 nm and the average spacing is λ<A, the internal oxidation is too strong, which has a significant influence on toughness and formability of the steel plate. Therefore, in order to ensure good phosphatability of the steel plate, the thickness of the inner oxide layer in the surface layer of the steel plate is controlled to be 1-5 μm, the average diameter of the oxide particles is controlled to be 50-200 nm, and the average spacing λ between the oxide particles is controlled to be between A and B.

The cold-rolled high-strength steel plate of the disclosure comprises residual austenite and ferrite in its room temperature structure, wherein the residual austenite content is 5-15%, the ferrite content is not higher than 50%, and the rest is martensite and/or bainite. During a deformation process, a certain amount of the residual austenite undergoes phase change and transforms into martensite, and the TRIP effect occurs, ensuring that the steel plate should have good formability while having a strength of 980 MPa. Ferrite acts as a soft phase in the structure, and a certain amount of ferrite can further improve the formability of the steel plate. If the residual austenite content is less than 5%, the TRIP effect will be not significant, and high formability of the steel plate cannot be guaranteed. If the residual austenite content is >15%, and the ferrite content is >50%, the amount of a hard phase in the steel plate will be rather small, and high strength of the steel plate cannot be achieved.

The present disclosure relates to a method of manufacturing a cold-rolled high-strength steel plate having excellent phosphatability and formability, comprising the following steps:

1) Smelting and Casting

Smelting and casting according to the above chemical composition to form a slab;

2) Hot Rolling and Coiling

Heating the slab to 1170-1300° C.; holding for 0.5-4 h; rolling, with a final rolling temperature ≥850° C.; and coiling at a coiling temperature of 400-600° C. to obtain a hot rolled coil;

3) Pickling and Cold Rolling

Uncoiling the hot rolled coil, pickling at a speed of 80-120 m/min, and cold rolling with a cold rolling reduction of 40-80% to obtain a rolled hard strip steel;

4) Continuous Annealing

Uncoiling the resulting rolled hard strip steel, cleaning, heating to a soaking temperature of 800-930° C., and holding for 30-200 s, wherein a heating rate is 1-20° C./s, and an atmosphere of the heating and holding stage is a $N_2$—$H_2$ mixed gas, wherein a $H_2$ content is 0.5-20%; wherein a dew point of an annealing atmosphere is from −25° C. to 10° C.;

followed by rapid cooling to 180-280° C. at a cooling rate ≥50° C./s;

further followed by reheating to 350-450° C. and holding for 60-250 s to obtain a cold-rolled high-strength steel plate having excellent phosphatability and formability.

Preferably, when the hot rolling in step 2) is performed, the temperature for reheating the slab is 1210-1270° C., and the coiling temperature is 450-520° C.

Further, in step 4), the dew point of the annealing atmosphere is from −15° C. to 0° C.

The manufacture process of the disclosure is designed for the following reasons:

In the hot rolling according to the present disclosure, the temperature for reheating the slab is 1170-1300° C., preferably 1210-1270° C. If the heating temperature is too high, the slab will be over-fired, and the grain structure in the slab will be coarse. As a result, the thermal processability of the slab will be degraded. In addition, the ultra-high temperature will cause severe decarburization in the surface of the slab. If the heating temperature is too low, after the slab is descaled with high-pressure water and initially rolled, deformation resistance of the blank will be too large due to the excessively low finishing temperature.

The holding time for the hot rolling in the present disclosure is 0.5-4 hours. If the holding time exceeds 4 hours, the grain structure in the slab will be coarse, and the surface of the slab will be decarburized seriously. If the holding time is less than 0.5 h, the internal temperature of the slab will not be uniform. According to the present disclosure, it's necessary to control the final rolling temperature to be 850° C. or higher to complete the hot rolling of the cast slab. If the final rolling temperature is too low, the deformation resistance of the slab will be too high. Consequently, it will be difficult to produce a steel plate of a specified thickness, and the plate shape will be poor.

In the present disclosure, the hot rolled plate is coiled at 400-600° C., and the coiling temperature is preferably 450-520° C. If the coiling temperature is too high, the mill scale formed on the surface of the steel plate will be too thick to be pickled. If the coiling temperature is too low, the strength of the hot rolled coil will be rather high, such that the hot rolled coil will be difficult to be cold rolled, affecting production efficiency.

In the course of pickling according to the disclosure, the pickling speed is 80-120 m/min. If the pickling speed is too fast, the mill scale on the surface of the steel plate cannot be removed completely, and surface defects will be formed. If the pickling speed is too slow, the speed of the rolling mill will be low, affecting control over plate shape and production efficiency.

After pickling, the hot-rolled steel plate is cold-rolled to deform it to a prescribed thickness, and the cold rolling reduction is 40-80%. A large cold rolling reduction can increase the formation rate of austenite in the subsequent annealing process. It helps to improve the uniformity of the structure of the annealed steel plate and thus improve the ductility of the steel plate. However, if the cold rolling reduction is too large, the deformation resistance of the material will be very high due to work hardening, so that it will be extremely difficult to prepare a cold-rolled steel plate having a prescribed thickness and a good plate shape.

In the annealing process according to the disclosure, the soaking temperature is controlled at 800-930° C., and the soaking time is 30-200 s. The soaking temperature and the soaking time are selected mainly with an eye to their influence on the matrix microstructure and properties of the strip steel, as well as their influence on the thickness of the inner oxide layer in the surface layer of the steel plate. The influence of the residual austenite content in the microstructure is a major factor that is considered when the rapid cooling temperature, the reheating temperature and the time of the reheating and holding are selected.

If the soaking temperature is lower than 800° C. and the soaking time is less than 30 s, austenitic transformation will not proceed sufficiently in the cold rolled steel plate, the austenite structure will not be homogeneous, and the ferrite content will exceed 50%. After the subsequent annealing process, a sufficient amount of residual austenite cannot be formed. As a result, the strength of the steel plate is low, and the elongation is insufficient. If the soaking temperature is higher than 930° C. and the soaking time is longer than 200 s, the matrix structure of the steel plate will undergo complete austenitic transformation after the soaking treatment. The austenite stability will be reduced, so that the residual austenite content in the matrix of the steel plate will be decreased after annealing, and no ferrite will be retained. Hence, the strength of the steel plate will be rather high, and the elongation will be insufficient. In addition, under the above conditions, the thickness of the inner oxide layer formed in the surface layer of the steel plate after annealing will be >5 μm, which will further affect the toughness and formability of the steel plate.

In the rapid cooling stage according to the present disclosure, the rapid cooling temperature is controlled at 180-280° C., and the cooling rate is controlled at ≥50° C./s. In the compositional design according to the present disclosure, the critical cooling rate of martensite is 50° C./s. In order to make sure that only the martensitic transformation occurs during the cooling process, the cooling rate is not less than 50° C./s. If the rapid cooling temperature is lower than 180° C., all austenite will undergo martensitic transformation. Then, the room temperature structure of the steel plate is ferrite and martensite without formation of residual austenite. As a result, the elongation of steel plate is insufficient. If the rapid cooling temperature is higher than 280° C., the martensitic transformation will not undergo fully, and the content and stability of the residual austenite will be insufficient in the subsequent reheating process, affecting the strength and formability of the steel plate.

The reheating temperature is controlled at 350-450° C., and the reheating time is 60-250 s according to the disclosure. If the reheating temperature is lower than 350° C. and the reheating time is less than 60 s, the residual austenite in the steel plate will not be stabilized sufficiently, and the content of the residual austenite in the room temperature structure will not be enough. If the reheating temperature is higher than 450° C. and the heating time is longer than 250 s, the steel plate will undergo significant temper softening, and the material strength will be reduced notably.

According to the present disclosure, a $N_2$—$H_2$ mixed gas is employed for the annealing atmosphere of the heating and soaking stages, wherein the H2 content is 0.5-20%, the purpose of which is to reduce the iron oxide in the surface of the strip steel. The dew point of the annealing atmosphere is from −25° C. to 10° C., preferably from −15° C. to 0° C. In the above range of the dew point, the annealing atmosphere is reductive for Fe, so that the iron oxide will be reduced. If the dew point of the annealing atmosphere is lower than −25° C., the above annealing atmosphere will be oxidative for the Si element in the matrix, and Si in the matrix will form a continuous dense oxide film on the surface of the strip steel, and thus the phosphatability will be affected. If the dew point of the annealing atmosphere is higher than 10° C., the oxygen potential in the annealing atmosphere will be too high, and the ability of O atoms to diffuse into the matrix of the strip steel will be increased, leading to formation of an excessively thick inner oxide layer of alloy elements such as Si and Mn in the surface layer of the steel plate, which will affect the strength and formability of the steel plate. At the same time, Si and Mn begin to be enriched in the surface of the steel plate, so that the phosphatability of the steel plate will be deteriorated.

The disclosure has the following beneficial effects in comparison with the prior art:

1) The surface layer of the cold-rolled high-strength steel plate of the present disclosure comprises an inner oxide layer which comprises iron as a matrix, has a thickness of 1-5 μm and contains oxide particles. The inner oxide layer prevents elements such as Si, Mn and the like from being enriched in the surface of the steel plate. Therefore, the oxidation reaction of the above elements does not occur on the surface of the steel plate, and the external oxidation is replaced by internal oxidation. No Si or Mn element is enriched in the surface of the steel plate, thereby improving the phosphatability of the steel plate and ensuring the excellent phosphatability of the high Si cold-rolled high-strength steel plate.

2) The cold-rolled high-strength steel plate of the present disclosure comprises residual austenite and ferrite in its room temperature structure, and the rest is martensite and/or bainite. During the deformation process, a certain amount of the residual austenite undergoes phase change and transforms into martensite, and the TRIP effect occurs, ensuring that the steel plate should have good formability while having a strength of 980 MPa. At the same time, a certain amount of ferrite can further improve the formability of the steel plate.

3) In the annealing process according to the disclosure, the soaking temperature is controlled at 800-930° C., and the soaking time is controlled at 30-200 s. The soaking temperature and the soaking time are selected mainly with an eye to their influence on the matrix microstructure and properties of the strip steel, as well as their influence on the thickness of the inner oxide layer in the surface layer of the steel plate. The influence of the residual austenite content in the microstructure is a major factor that is considered when the rapid cooling temperature, the reheating temperature and the time of the reheating and holding are selected.

4) In the annealing process according to the disclosure, a $N_2$—$H_2$ mixed gas is employed for the annealing atmosphere of the heating and soaking stages, wherein the H2 content is 0.5-20%, so as to reduce the iron oxide in the surface of the strip steel. The dew point of the annealing atmosphere is from −25° C. to 10° C. In the above range of the dew point, the selected annealing atmosphere is reductive for Fe, so that the iron oxide will be reduced.

5) The production of the cold-rolled high-strength steel plate of the present disclosure can be completed on an existing continuous annealing production line for high-strength steel, with no need for big adjustment. The cold-rolled high-strength steel plate has a promising prospect of application in automobile structural parts, particularly suitable for manufacture of automobile structural parts and safety parts having complex shapes and high requirements for formability and corrosion resistance, such as door impact beams, bumpers and B-pillars.

DETAILED DESCRIPTION

The cold-rolled high-strength steel plate having excellent phosphatability and formability and the manufacturing method thereof according to the disclosure will be further explained and illustrated with reference to the accompanying drawings and the specific examples. Nonetheless, the explanation and illustration are not intended to unduly limit the technical solution of the disclosure.

EXAMPLES AND COMPARATIVE EXAMPLES

Cold-rolled high-strength steel plates having excellent phosphatability and formability in Examples 1-20 according to the present disclosure and steel plates in Comparative Examples 1-6 were obtained by the following steps:

Table 1 lists the mass percentages (%) of the chemical elements in the steel of Examples 1-20 and Comparative Examples 1-6.

A steel material having a composition shown in Table 1 was smelted and cast to form a slab. The slab was heated at a heating temperature of 1250° C. for 1 h, and then hot rolled. Finish rolling was fulfilled at a final rolling temperature of 900° C. or higher. The hot-rolled steel plate had a thickness of about 2.5 mm. The hot-rolled steel plate was coiled at 450° C., pickled and cold-rolled with a cold rolling reduction of 60%. The final thickness of the rolled hard strip steel was 1.0 mm.

The resulting rolled hard strip steel was uncoiled, cleaned, annealed, and then evaluated for mechanical properties, residual austenite content, ferrite content, inner oxide layer thickness in the surface layer, average diameter of oxide particles, average spacing between particles and phosphatability of the cold-rolled high-strength steel plate after the annealing. The annealing process and atmosphere conditions employed in the Examples and Comparative Examples are shown in Table 2, and the evaluation results are shown in Table 3.

Figure 1:
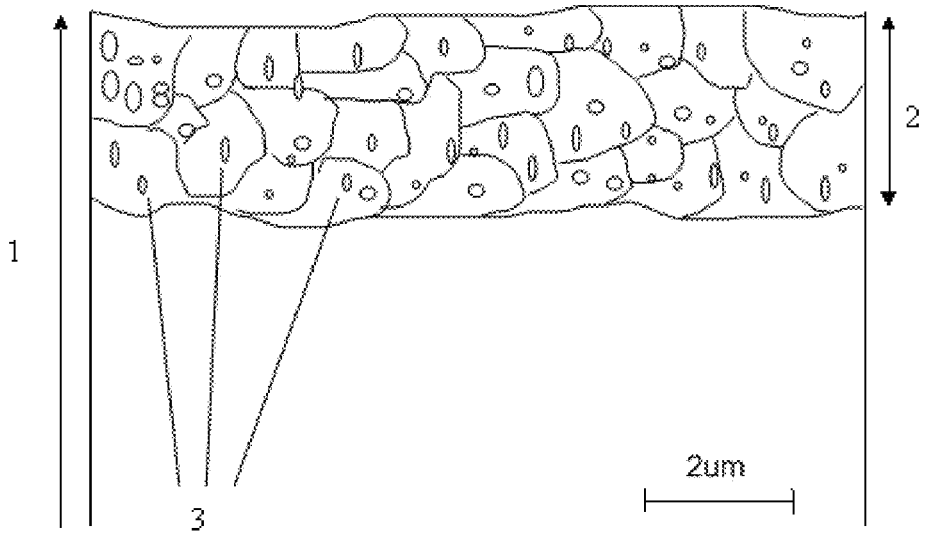
FIG. 1 is a schematic view showing an inner oxide layer in a surface of a cold-rolled high-strength steel plate according to an embodiment of the present disclosure, wherein 1 represents a steel plate, 2 represents oxide particles, and 3 represents an inner oxide layer.
Figure 2:
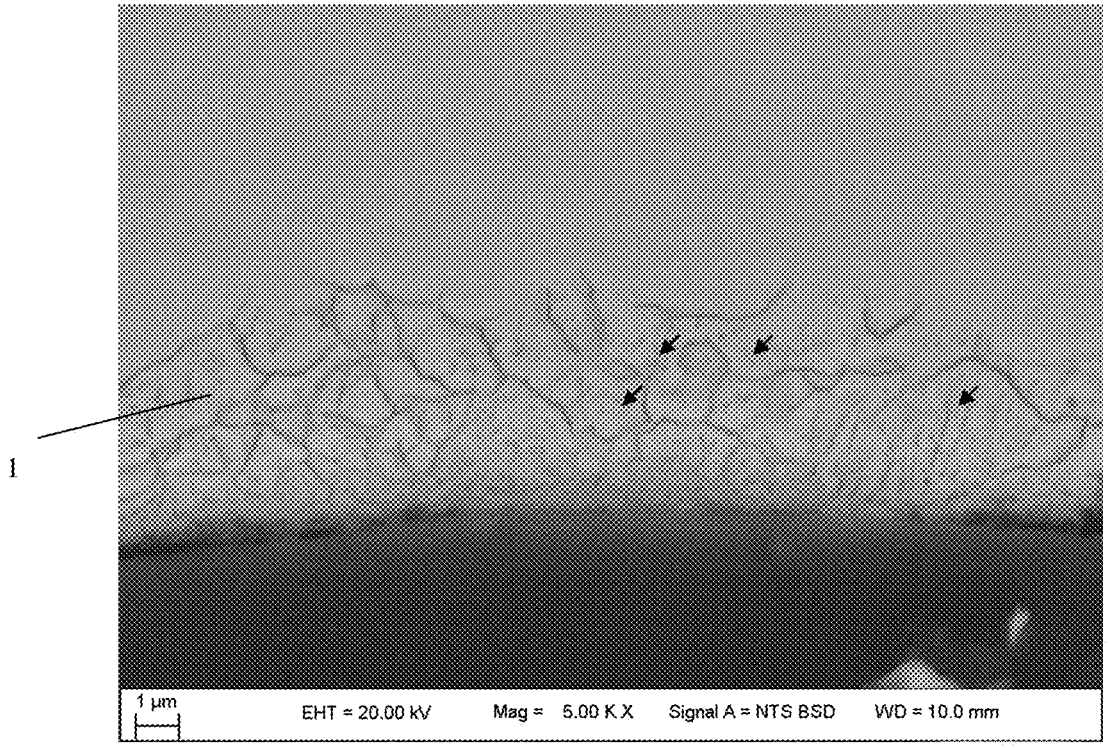
FIG. 2 is an SEM (scanning electron microscopy) backscattered electron image of a cross-section of a cold-rolled high-strength steel plate according to an embodiment of the present disclosure, wherein 1 represents an inner oxide layer in the surface layer of the steel plate, and the arrows indicate oxide particles.
Figure 3:
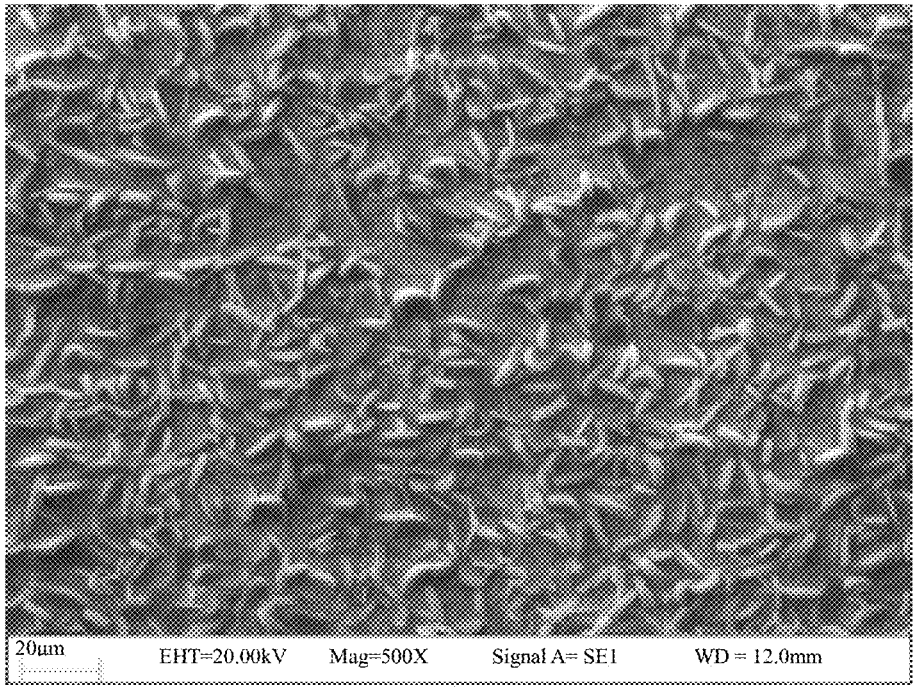
FIG. 3 is an SEM secondary electron image of a surface of a phosphated cold-rolled high-strength steel plate according to an embodiment of the present disclosure.

As can be seen from Table 3, all the Examples with the annealing process of the present disclosure used had a tensile strength of 980 MPa or higher, an elongation of 20% or higher, and a residual austenite content of 5-15% and a ferrite content of no higher than 50% in the room temperature structure. At the same time, by controlling the dew point of the annealing atmosphere, an inner oxide layer existed in the surface layer of the steel plate. The characteristics of the inner oxide layer are shown in FIGS. 1-2. After phosphating, the phosphated crystals covered the surface of the steel plate uniformly, and the crystal size was small, wherein the coverage area exceeded 80%, indicating excellent phosphatability, as shown by FIG. 3.

Figure 4:
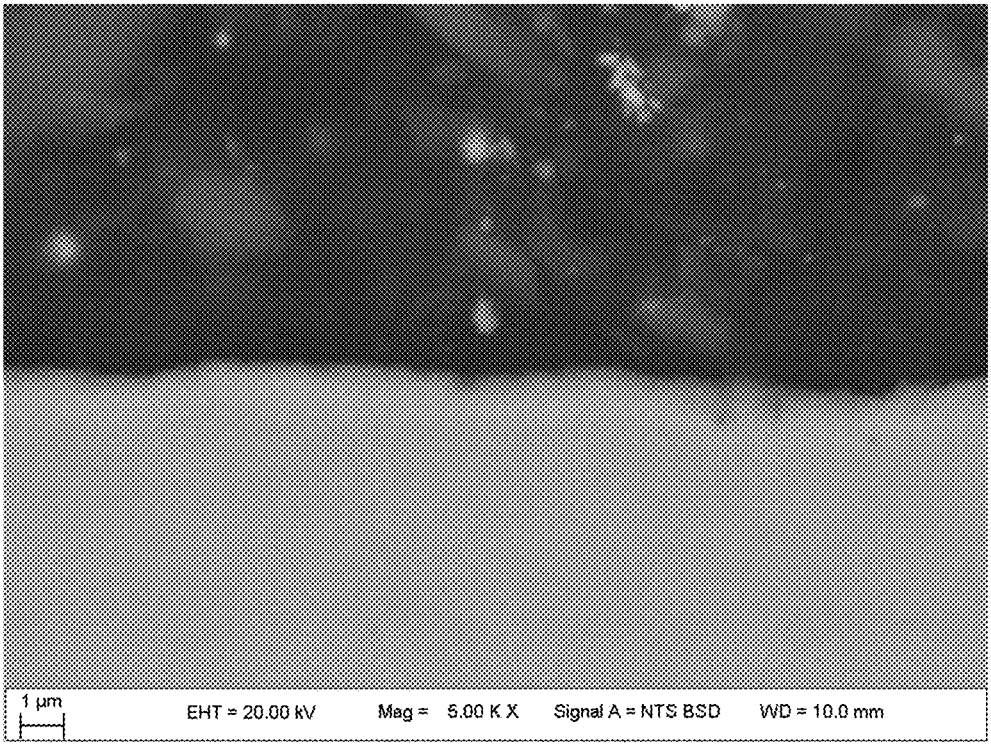
FIG. 4 is an SEM backscattered electron image of a cross-section of a cold-rolled high-strength steel plate of Comparative Example 1, in which the surface layer of the steel plate has no internal oxide layer.
Figure 5:
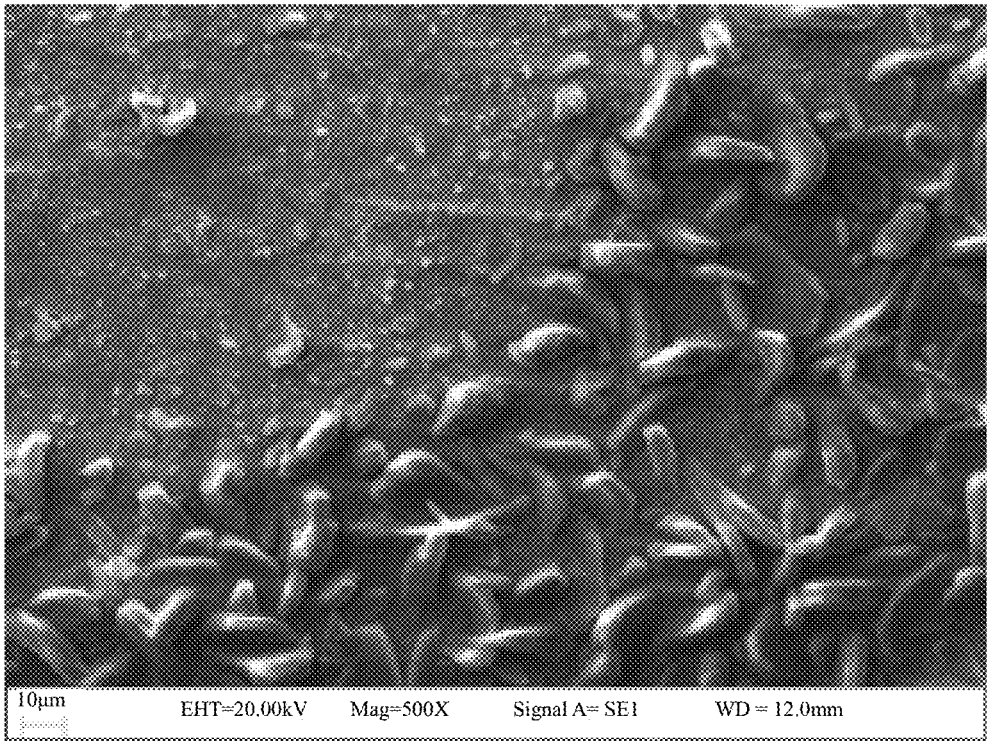
FIG. 5 is an SEM secondary electron image of a surface of a phosphated cold-rolled high-strength steel plate of Comparative Example 1.

As known from a combination of Tables 2 and 3, the dew point of Comparative Example 1 was −40° C., far lower than the lower limit designed by the present disclosure, and no inner oxide layer was formed in the surface (see FIG. 4). Instead, Si and Mn were enriched in the surface of the steel plate. Therefore, after phosphating of the steel plate, phosphated crystals only appeared in local areas of the surface, the crystal size was large, and most of the surface was not covered by phosphated crystals, indicating poor phosphatability, as shown by FIG. 5.

The rapid cooling temperature of Comparative Example 2 was 100° C., far lower than the designed lower limit. The austenite was all transformed into martensite, and thus there was no residual austenite. Therefore, the strength of the steel plate was rather high, and the elongation was rather low.

The soaking temperature of Comparative Example 3 was 770° C., lower than 800° C. required by the design, and the ferrite content during annealing was rather high. Therefore, the strength of the material was rather low.

The reheating temperature of Comparative Example 4 was 500° C. which exceeded the designed upper limit, and the martensite in the steel plate was significantly tempered and softened, resulting in a decrease in strength and elongation.

In Comparative Example 5, due to the use of a dew point exceeding the upper limit designed by the present disclosure, the inner oxide layer in the surface of the steel plate was rather thick, which affected the tensile strength and elongation of the material. At the same time, the excessively high dew point caused reenrichment of Si and Mn elements in the surface of the steel plate. As a result, the phosphatability of the steel plate began to deteriorate again.

As known from a combination of Tables 1 and 3, the silicon content of Comparative Example 6 was less than 1.5%, and its elongation was unable to reach 20%. This is because the Si content did not reach the designed lower limit. Therefore, during the annealing process, the content of the residual austenite was insufficient, resulting in a low elongation.

Tensile test method was as follows: A No. 5 tensile test specimen under JIS was used, and the tensile direction was perpendicular to the rolling direction.

Method of measuring a residual austenite content: A specimen of 15×15 mm in size was cut from a steel plate, ground, polished, and tested quantitatively using XRD.

Method of measuring a ferrite content: A specimen of 15×15 mm in size was cut from a steel plate, ground, polished, and analyzed quantitatively using EBSD.

Method of measuring a thickness of an oxide layer in a surface layer of a steel plate: Steel plates were sampled along their cross-sections. After grinding and polishing, the cross-sectional morphologies were observed for all the steel plate samples at a magnification of 5000 times under a scanning electron microscope.

Method of measuring an average diameter and an average spacing of oxide particles in an oxide layer: A steel plate was sampled along its cross-section. After grinding and polishing, 10 fields of view were observed randomly at a magnification of 10000 times under a scanning electron microscope, and an image software was used to calculate the average diameter and average spacing of the oxide particles.

Method of evaluating phosphatability of a steel plate: An annealed steel plate was subjected to degreasing, water washing, surface conditioning and water washing in order, and then phosphated, followed by water washing and drying. The phosphated steel plate was observed in 5 random fields of view at a magnification of 500 times under a scanning electron microscope, and an image software was used to calculate the area not covered by the phosphated film. If the uncovered area was less than 20%, the phosphatability was judged to be good (OK); and conversely, the phosphatability was judged to be poor (NG).

TABLE 1

| | C | Si | Mn | P | S | Al | N |
|---|---|---|---|---|---|---|---|
| A | 0.15 | 2.1 | 2.0 | 0.012 | 0.002 | 0.037 | 0.0031 |
| B | 0.12 | 1.7 | 2.5 | 0.010 | 0.005 | 0.053 | 0.0035 |
| C | 0.18 | 1.7 | 2.3 | 0.013 | 0.006 | 0.040 | 0.0041 |
| C | 0.16 | 1.9 | 2.1 | 0.008 | 0.009 | 0.032 | 0.0043 |
| E | 0.20 | 1.5 | 1.8 | 0.009 | 0.010 | 0.060 | 0.0052 |
| F | 0.17 | 1.2 | 2.2 | 0.015 | 0.006 | 0.045 | 0.0037 |

TABLE 2

| | | Annealing Process | | | | | |
|---|---|---|---|---|---|---|---|
| No. | Composition | Dew point of annealing atmosphere (° C.) | Soaking temperature (° C.) | Soaking time (s) | Rapid cooling temperature (° C.) | Reheating temperature (° C.) | Reheating time (s) |
| Ex. 1 | A | −15 | 840 | 120 | 240 | 375 | 240 |
| Ex. 2 | A | −10 | 875 | 100 | 220 | 400 | 60 |
| Ex. 3 | A | 10 | 822 | 55 | 280 | 420 | 120 |
| Ex. 4 | A | 5 | 800 | 150 | 180 | 393 | 170 |
| Ex. 5 | B | 5 | 902 | 60 | 260 | 405 | 150 |
| Ex. 6 | B | −10 | 834 | 100 | 240 | 390 | 103 |
| Ex. 7 | B | 0 | 805 | 180 | 280 | 430 | 208 |
| Ex. 8 | B | 10 | 850 | 120 | 210 | 410 | 180 |
| Ex. 9 | C | −10 | 810 | 125 | 215 | 403 | 140 |
| Ex. 10 | C | −15 | 869 | 84 | 275 | 442 | 220 |
| Ex. 11 | C | 5 | 893 | 105 | 240 | 385 | 167 |
| Ex. 12 | C | 10 | 827 | 200 | 200 | 400 | 160 |
| Ex. 13 | D | 0 | 805 | 140 | 210 | 405 | 100 |
| Ex. 14 | D | −10 | 904 | 79 | 240 | 394 | 235 |
| Ex. 15 | D | −10 | 845 | 104 | 280 | 420 | 127 |
| Ex. 16 | D | −5 | 820 | 197 | 255 | 368 | 80 |
| Ex. 17 | E | −15 | 889 | 115 | 240 | 405 | 100 |
| Ex. 18 | E | 5 | 860 | 75 | 180 | 412 | 175 |
| Ex. 19 | E | 0 | 850 | 129 | 220 | 385 | 130 |
| Ex. 20 | E | 10 | 820 | 102 | 260 | 430 | 110 |
| Comp. Ex. 1 | A | −40 | 830 | 90 | 270 | 410 | 80 |
| Comp. Ex. 2 | B | −15 | 820 | 150 | 100 | 400 | 140 |
| Comp. Ex. 3 | C | −10 | 770 | 120 | 260 | 375 | 170 |
| Comp. Ex. 4 | D | 0 | 850 | 75 | 250 | 500 | 110 |
| Comp. Ex. 5 | E | 15 | 900 | 105 | 280 | 425 | 120 |
| Comp. Ex. 6 | F | −15 | 830 | 120 | 260 | 410 | 210 |

TABLE 3

| | Mechanical Properties | | | Thickness of Inner Oxide | Oxide Particle | Average Interparticle | Residual Austenite | Ferrite | |
|---|---|---|---|---|---|---|---|---|---|
| No. | YS (MPa) | TS (MPa) | TEL (%) | Layer (μm) | Diameter (nm) | Spacing (nm) | Content (%) | Content (%) | Phosphatability |
| Ex. 1 | 678 | 1047 | 22.7 | 1.5 | 84 | 115 | 13 | 30 | OK |
| Ex. 2 | 770 | 1067 | 21.1 | 2.3 | 99 | 135 | 9 | 20 | OK |
| Ex. 3 | 622 | 1009 | 23.1 | 4.3 | 187 | 256 | 12 | 35 | OK |
| Ex. 4 | 579 | 1035 | 20.1 | 2.8 | 112 | 153 | 7 | 40 | OK |
| Ex. 5 | 800 | 1054 | 20.5 | 3.1 | 147 | 200 | 5 | 10 | OK |
| Ex. 6 | 671 | 1012 | 22.1 | 2.2 | 107 | 145 | 11 | 28 | OK |
| Ex. 7 | 592 | 987 | 24.1 | 2.7 | 132 | 179 | 15 | 31 | OK |
| Ex. 8 | 775 | 1032 | 20.6 | 3.9 | 173 | 235 | 9 | 26 | OK |
| Ex. 9 | 622 | 1017 | 25.2 | 2.1 | 79 | 105 | 14 | 25 | OK |
| Ex. 10 | 710 | 1089 | 20.6 | 1.7 | 64 | 85 | 6 | 18 | OK |
| Ex. 11 | 830 | 1092 | 20 | 2 | 70 | 93 | 5 | 15 | OK |
| Ex. 12 | 724 | 1053 | 20.7 | 3.9 | 171 | 228 | 8 | 27 | OK |
| Ex. 13 | 602 | 986 | 23.6 | 2.6 | 134 | 180 | 13 | 35 | OK |
| Ex. 14 | 830 | 1089 | 20 | 2.5 | 120 | 161 | 5 | 5 | OK |
| Ex. 15 | 730 | 1028 | 21.5 | 2.2 | 120 | 161 | 10 | 20 | OK |

TABLE 3-continued

| No. | Mechanical Properties YS (MPa) | TS (MPa) | TEL (%) | Thickness of Inner Oxide Layer (μm) | Oxide Particle Diameter (nm) | Average Interparticle Spacing (nm) | Residual Austenite Content (%) | Ferrite Content (%) | Phosphatability |
|---|---|---|---|---|---|---|---|---|---|
| Ex. 16 | 654 | 1011 | 20.9 | 2.6 | 129 | 173 | 9 | 25 | OK |
| Ex. 17 | 810 | 1058 | 20.7 | 1.9 | 101 | 123 | 7 | 10 | OK |
| Ex. 18 | 800 | 1072 | 20.1 | 3.4 | 155 | 188 | 7 | 20 | OK |
| Ex. 19 | 793 | 1047 | 20.5 | 2.9 | 127 | 154 | 8 | 22 | OK |
| Ex. 20 | 702 | 994 | 21.3 | 4.2 | 180 | 219 | 10 | 27 | OK |
| Comp. Ex. 1 | 626 | 1044 | 21.8 | 0 | 0 | 0 | 10 | 30 | NG |
| Comp. Ex. 2 | 800 | 1161 | 13.4 | 1.5 | 90 | 122 | 0 | 30 | OK |
| Comp. Ex. 3 | 526 | 971 | 20.1 | 2.3 | 105 | 140 | 6 | 60 | OK |
| Comp. Ex. 4 | 605 | 962 | 19.3 | 3.1 | 150 | 201 | 8 | 25 | OK |
| Comp. Ex. 5 | 830 | 1131 | 13.7 | 7.6 | 275 | 23 | 5 | 5 | NG |
| Comp. Ex. 6 | 740 | 1018 | 17.3 | 1.3 | 87 | 102 | 4 | 35 | OK |

What is claimed is:

1. A cold-rolled high-strength steel plate having excellent phosphatability and formability, comprising chemical elements in percentage by mass of:

C 0.10 to 0.20%, Si 1.50 to 2.50%, Mn 1.50 to 2.50%, P 0.02%, S 0.02%, Al 0.03 to 0.06%, N 0.01%, and a balance of Fe and unavoidable impurity elements, wherein a surface layer of the cold-rolled high-strength steel plate comprises an inner oxide layer having a thickness of 1 to 5 μm; the inner oxide layer comprises iron as a matrix; the matrix comprises oxide particles which are at least one of Si oxides, composite oxides of Si and Mn; and no Si or Mn element is enriched in the surface of the steel plate;

wherein the oxide particles have an average diameter of 50 to 200 nm and an average spacing A between the oxide particles satisfying the following relationship:

$$A=0.115\times(0.94\times[Si]+0.68\times[Mn])^{1/2}\times d$$

$$B=1.382\times(0.94\times[Si]+0.68\times[Mn])^{1/2}\times d$$

$$A\leq\lambda\leq B$$

wherein [Si] is the content % of Si in the steel; [Mn] is the content % of Mn in the steel; and d is the diameter of the oxide particles in nm;

wherein the cold-rolled high-strength steel plate has a tensile strength ≥980 MPa, and an elongation ≥20%, wherein a room temperature structure of the cold-rolled high-strength steel plate has a residual austenite content of 5-15%, a ferrite content of ≤35%, and a balance of martensite and/or bainite, and wherein the steel plate comprises a surface covered with phosphate crystals in a coverage area exceeding 80%.

2. The cold-rolled high-strength steel plate having excellent phosphatability and formability according to claim 1, wherein the oxide particles are at least one of silicon dioxide ($S_iO_2$), manganese silicate, iron silicate and ferromanganese silicate.

3. A manufacturing method for the cold-rolled high-strength steel plate having excellent phosphatability and formability according to claim 1, comprising the following steps:

1. Smelting and casting

Smelting and casting the chemical composition of claim 1 to form a slab;

2. Hot rolling and coiling

Heating the slab to 1170-1300° C.; holding for 0.5-4h; rolling, with a final rolling temperature 850° C.; and coiling at a coiling temperature of 400-600° C. to obtain a hot rolled coil;

3. Pickling and cold rolling

Uncoiling the hot rolled coil, pickling at a speed of 80-120 m/min, and cold rolling with a cold rolling reduction of 40-80% to obtain a rolled hard strip steel;

4. Continuous Annealing

Uncoiling and cleaning the resulting rolled hard strip steel;

Heating to a soaking temperature of 800-930 ° C., and holding for 30-200 s, wherein a heating rate is 1-20 ° C/s, and an atmosphere of the heating and holding stage is a $N_2$-$H_2$ mixed gas, wherein a $H_2$ content is 0.5-20%; wherein a dew point of an annealing atmosphere is from −25° C. to 10° C.;

Then rapid cooling to 180-280° C. at a cooling rate 50° C/s;

Then reheating to 350-450° C. and holding for 60-250 s to obtain the cold-rolled high-strength steel plate having excellent phosphatability and formability.

4. The manufacturing method for the cold-rolled high-strength steel plate having excellent phosphatability and formability according to claim 3, wherein when the hot rolling in step 2) is performed, the temperature for reheating the slab is 1210-1270° C.

5. The manufacturing method for the cold-rolled high-strength steel plate having excellent phosphatability and formability according to claim 3, wherein the coiling temperature in step 2) is 450-520° C.

6. The manufacturing method for the cold-rolled high-strength steel plate having excellent phosphatability and formability according to claim 3, wherein the dew point of the annealing atmosphere is from −15° C. to 0° C.

7. The manufacturing method for the cold-rolled high-strength steel plate having excellent phosphatability and formability according to claim 3, wherein oxide particles of the cold-rolled high-strength steel plate having excellent phosphatability and formability are at least one of silicon oxide, manganese silicate, iron silicate and ferromanganese silicate.

8. The manufacturing method for the cold-rolled high-strength steel plate having excellent phosphatability and formability according to claim 7, wherein when the hot rolling in step 2) is performed, the temperature for reheating the slab is 1210-1270° C.

9. The manufacturing method for the cold-rolled high-strength steel plate having excellent phosphatability and formability according to claim 7, wherein the coiling temperature in step 2) is 450-520° C.

10. The manufacturing method for the cold-rolled high-strength steel plate having excellent phosphatability and formability according to claim 7, wherein the dew point of the annealing atmosphere is from −15° C. to 0° C.

11. The manufacturing method for the cold-rolled high-strength steel plate having excellent phosphatability and formability according to claim 7, wherein a room temperature structure of the cold-rolled high-strength steel plate has a residual austenite content of 5-15%, a ferrite content of no more than 35% and a balance of martensite and/or bainite.

12. The manufacturing method for the cold-rolled high-strength steel plate having excellent phosphatability and formability according to claim 10, wherein the cold-rolled high-strength steel plate has a tensile strength ≤980 MPa, and an elongation ≤20%.

* * * * *